US005152636A

United States Patent [19]

Myers

[11] Patent Number: 5,152,636

[45] Date of Patent: Oct. 6, 1992

[54] REEL MOUNTABLE BOOM APPARATUS

[76] Inventor: Frank Myers, 317 Calle Mayor, Redondo Beach, Calif. 90277

[21] Appl. No.: 656,954

[22] Filed: Feb. 15, 1991

[51] Int. Cl.[5] ..... E02B 15/06

[52] U.S. Cl. ..... 405/68; 405/72

[58] Field of Search ..... 405/63-72; 210/242.3, 923

[56] References Cited

U.S. PATENT DOCUMENTS

| | | | |
|---|---|---|---|
| 3,592,008 | 7/1971 | Trindle | 405/72 X |
| 3,613,377 | 10/1971 | Zaugg | 405/72 X |
| 3,744,253 | 7/1973 | Williams et al. | 405/66 |
| 3,798,911 | 3/1974 | Oberg | 405/69 |
| 3,811,285 | 5/1974 | Ballu | 406/69 |
| 4,030,304 | 6/1977 | West | 405/72 X |
| 4,068,478 | 1/1978 | Meyers et al. | 405/66 |
| 4,124,981 | 11/1978 | Preus | 405/66 |
| 4,295,755 | 10/1981 | Meyers | 405/66 |
| 4,511,285 | 4/1985 | Eriksson | 405/66 |
| 4,752,393 | 6/1988 | Meyers | 405/72 X |

*Primary Examiner*—David H. Corbin
*Attorney, Agent, or Firm*—Ladas & Parry

[57] ABSTRACT

A contamination containment boom section of the type adapted to contain a contaminant in a preselected location on a body of liquid, the boom having an elongated flotation body adapted to float on the body of liquid and a weighted skirt member depending from the flotation body and extending downwardly a preselected distance into the body of liquid. The flotation body has a large water plane area compared to its top and is preferably, but not necessarily substantially triangular in cross section with rounded apices. The flotation body comprises a plurality of ribs each having the general shape of the cross section of the flotation body. The ribs, together with an optional plastic liner, a plurality of elongated mounting strips, and fasteners for fastening the ribs to the mounting strips and for optionally fastening the mounting strips to the plastic liner at intervals therealong, make up a skeleton framework for the flotation body. A flexible plastic cover completely surrounds and conforms to the shape of the skeleton framework to envelop an inner elongated flotation chamber. A closed cell foam float is located at the bottom of the flotation chamber. The top portion of each rib folds down toward the bottom portion to put the transverse portion into torsion, and enabling the skeleton and, in turn, the flotation body to collapse. For stability against external forces tending to tip the flotation means, lengthwise ballast bags and/or hypotenusal ties may be employed.

41 Claims, 6 Drawing Sheets

REEL MOUNTABLE BOOM APPARATUS

BACKGROUND OF THE INVENTION

1. Field of the Invention

This invention relates to the flotation barrier or boom art, and, more particularly, to an improved contamination containment barrier or boom.

2. Description of the Prior Art

The increased frequency of contamination of bodies of water such as rivers, harbors, lakes, oceans, and the like, by, for example, oil spills, has increased the need for effective containment barriers or booms wherein the area of the liquid body having the contamination may be separated from adjacent areas of the liquid body and the contamination contained within the sectioned off area. The contamination may be removed without further contamination of additional areas.

Various types of booms have heretofore been utilized for providing the barrier separating the contamination area from uncontaminated areas. One type of boom that has been widely utilized is a flotation boom, generally fabricated in sections. Each section of the boom may be coupled to adjacent sections to form an entire boom of any desired length deployed in any desired geometrical configuration to contain the contamination area. Such flotation booms have generally incorporated a flotation means floating on the surface of the liquid and a depending weighted skirt extending from the bottom of the flotation means into the liquid. The skirt has a predetermined depth and generally incorporates a ballast, and preferably a tension member. A towing nose and/or towing tail is usually attached to the end sections of the assembled boom providing a strong and convenient means of coupling the boom to a towing vessel or ship.

The older forms of flotation means heretofore utilized have comprised, for example, logs, sealed rigid containers such as empty drums, inflatable tubular members, tubular members filled with a buoyant material, i.e., a material having a specific gravity less than 1.0, or similar devices. However, such older prior art flotation means arranged as a containment boom have generally not proven to be completely satisfactory.

Since the containment boom is often stored comparatively long periods of time and only deployed on the liquid when it is necessary for training or to contain a contaminated area, the storage volume should preferably be as small as possible. Also, since boom performance is a function of flotation volume, storage volume tends to be very large. Further, since the contamination may occur quite suddenly, the boom should be able to be rapidly deployed with comparatively low drag and low turbulence inducement in the liquid. Further, it should be deployable without utilizing sophisticated machinery and/or highly skilled labor.

Additionally, it is also desired that the boom be capable of articulation in both the horizontal and vertical directions, while generally maintaining its cross-sectional configuration, in response to the forces imposed by winds, waves, and the like. A boom of such design minimizes stress imposed on the boom, maintains desired draft and freeboard, and minimizes splash-over. Further, each boom section is preferably fabricated in as longitudinally long sections as possible to avoid complications on deployment or when used, and to reduce costs associated with boom section connections.

Inflatable booms enable relatively small storage volumes to present relatively large flotation when deployed. One form of inflatable boom heretofore utilized has incorporated a plurality of boom sections, each approximately 25 yards long and has a flotation portion and a depending skirt portion. The flotation portion is of flexible fabric and has a generally rectangular configuration in the deployed condition and is transversely collapsible in the stored condition to a flat configuration in which it may, for example, be coiled. Each section is comprised of a plurality of elements on the order of 1 to 2 yards long. Each element has one or more individual spring loaded, pivotally connected, rectangular frames and a check valve for admitting air into the section. In the collapsed, or storage condition, the springs allow the collapse of the rectangular frames to permit the boom to assume the transversely flat storage configuration. Means are provided, in the storage configuration, to resist the spring forces and prevent opening of the boom. On deployment, the restraints are removed and the springs force the rectangular frames into the rectangular configuration, sucking aire into the tubular member through the check valve, and the trapped air in the boom provides buoyancy. The trapped air in the boom exceeds atmospheric pressure to resist the natural liquid forces acting thereon which tend to transversely collapse the boom and, thus, the combination of the trapped air and the spring loaded frames are required to maintain the structural integrity and buoyancy of the arrangement. On retrieval of the boom section, air must be vented by manual operation of the valves, and each rectangular frame must be collapsed and means provided to retain the collapsed configuration. Such operating mechanical structures in the interior of the boom, the automatic opening as well as the labor associated with retrieval, the leaking of liquid into the individual elements, the difficulty of removal of water and sinking of the boom, have made such boom elements unsatisfactory in may applications. Such a boom is described, for example, in U.S. Pat. No. 3,798,911.

Yet another type of boom is described in U.S. Pat. No. 3,576,108, but such structure as shown therein does not readily lend itself to a comparatively small volume for transport or storage.

Another type of boom is described in U.S. Pat. No. 3,686,869, in which a plurality of float chambers are connected to a dependent skirt portion extending below the surface of the body of liquid, and in each float chamber therein is provided a spring. While the boom of U.S. Pat. No. 3,686,869 may, under some circumstances be wound on a reel for storage, and then deployment therefrom, the springs in the storage condition are axially compressed against the spring constant. Further, the flotation chambers of the structure shown in U.S. Pat. No. 3,686,869 extend substantially perpendicular to the elongated longitudinal direction of the dependent skirt portion, thus adding considerable bulk, mass, and cost to another form of such a configuration.

U.S. Pat. No. 3,811,285 shows another form of boom arrangement, in which a plurality of flotation pockets, open at the bottom, are vertically arranged in spaced relationship throughout the longitudinally elongated boom section. Within the flotation pockets, there may be provided helical springs which have a plurality of straps coupling the coils of the spring to the vertically oriented pockets on the interior thereof. Thus, the axes of the helical springs are vertically oriented. While this configuration may be wound upon a reel for a storage condition, it has been found that collapsing the helical springs during the winding, because of their vertical orientation as opposed to the elongated longitudinal dimension of the boom section, presents considerable problems, since forces are not acting directly upon the spring to cause the collapse thereof into a flattened condition. That is, in winding the structure shown in U.S. Pat. No. 3,811,285 upon a reel, the forces act in a direction perpendicular to the axis of the helical coils and some additional force must be provided on the helical coils, acting in the axial direction to cause the coils to collapse to a flattened condition.

U.S. Pat. No. 4,068,478 discloses structure in which a helical member extends throughout the longitudinal direction of a tubular member, forming the flotation chamber of a containment boom section, and which is adapted to be longitudinally compressed during the storage thereof.

U.S. Pat. Nos. 3,803,848 and 4,295,755 disclose yet other configurations of a containment barrier or boom.

In my earlier PCT Application Number PCT/US80/01488, International Publication No. WO 81/03198, a self-inflating, collapsable containment barrier or boom is shown and described in which a continuous coil of spring-like material is resiliently deformable from a helical condition to a transversely flattened condition. Upon deployment, the coil reverts back to its helical condition, thereby expanding the tubular cover. While this arrangement has proven to be a functionally attractive and useful arrangement, manufacturing, handling, and installing a long spring coil is difficult and expensive. In this prior invention, a flexible flotation member is provided in the form of a thin flexible wrap surrounding the inner structure of the flotation tubular member.

Another prior art contamination control boom which uses a helical wire interior structure and float means is shown and described in my prior U.S. Pat. No. 4,752,393 issued Jun. 21, 1988. While this patent shows an internal foam strip, it is held in place by an attachment means structure which requires assembly and adds to the complexity and cost of the arrangement.

It has been found that a boom, which may be windable upon a reel during the storage thereof, and have reduced volume when so wound on the reel, but automatically expand to its desired volume upon deployment or unwinding from the reel, and which is constructed to include enough foam flotation to assure buoyancy even if inflated chambers are full, offers many advantages in certain applications. To achieve such automatic expansion to a full flotation condition upon deployment, it is preferred that the mechanism providing such expansion be substantially free of comparatively complex mechanical elements, and, further, that the structure should collapse automatically, during the winding upon the reel, without utilization of any other forces to cause the collapse of the structure. Additionally, of course, the boom section should expand into its full flotation volume upon deployment from the reel, and, once again, such expansion should also be achieved without the requirement of applying any other forces except the unwinding from the reel to achieve such an expanded condition.

SUMMARY OF THE INVENTION

The present invention satisfies a long felt need for an improved reel mountable contamination containment boom apparatus, free of the problems associated with prior art apparatuses and having the desirable features just described. According to the invention, there is provided a self-inflating, collapsible contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid. The flotation means has a large water plane area compared to its top and is preferably, but not necessarily substantially triangular in cross section with rounded apices. The flotation means comprises a plurality of wire-like members each having the general shape of the cross section of the flotation means, i.e., preferably in the shape of a triangle with rounded apices. A lower side of each wire-like member defines a base portion and the lateral sides extend upwardly from the base portion to meet at an apex opposite the base portion to define a top portion. A transverse portion extends from at least one of the lateral sides toward the opposite lateral side of the wire-like member. A relatively stiff lower plastic liner extends the length of the flotation means, the width of the lower plastic liner being wider than the base portion of the wire like member. A relatively stiff upper plastic liner, greater in width than the apex of the top portion, extends the length of a flotation means. A closed cell planar foam strip is positioned below the lower plastic liner. A plurality of elongated mounting strips, preferably metal also extend the length of the flotation means, and fastening means are provided for fastening the wire-like members to the mounting strips and for fastening the mounting strips to the upper and lower plastic liners at intervals therealong to produce a skeleton framework for the flotation means, with the wire-like members mounted transversely to the mounting strips and between the upper and lower plastic liners, the upper plastic liner being fastened at the top portion of each wire-like member, and the lower plastic liner being fastened at the base portion of each wire-like member. Importantly, the flotation boom section made in accordance with the present invention will function adquately without the upper and lower liners. Moreover, instead of upper and lower liners, a continuous liner could be formed either by wrapping the skeleton frame in a single piece of liner material or by joining wider strips of upper and lower plastic liner. If there is no liner, the skeleton framework is placed directly on the foam strip and may or may not be mounted thereto. A relatively flexible plastic cover defining contaminant impervious walls completely surrounds and conforms to the shape of the skeleton framework of the flotation means to envelop an inner elongated flotation chamber and provide end walls closing the ends of the chamber. The longitudinal side edges of the lower plastic liner turn up and in to conform to the rounded apices of the interior of the cover.

The invention further provides that one end of each transverse portion of the wire-like member is connected to the top portion thereof, and the other end of the transverse portion is connected to the bottom portion thereof, thereby allowing the top portion to fold down toward the bottom portion to put the transverse portion into torsion and the upright portions into slight bending, and enabling the skeleton and, in turn, the flotation means to collapse under a sufficient pressure, and storing energy to be released permitting the flotation means to expand upon release of such pressure.

In one aspect of the invention, the wire-like member is formed as a continuous loop running from the center of the base portion, around one base apex and up one lateral side to a predetermined distance from the top portion, then transversely toward the opposite lateral side, around a sharp reverse bend, back transversely toward the first lateral side, then upwardly and around the top apex to form the top portion, then downwardly to a predetermined distance from the base portion, then transversely toward the first lateral side, around a sharp reverse bend, back transversely toward the opposite lateral side, then downwardly, around the other base apex, and back to the center of the base portion, each part of the wire-like member which runs transversely, excluding the base portion, defining the aforementioned transverse portion.

The invention further provides a hollow tubular member surrounding the transverse portion of the wire-like member and extending substantially the length of the transverse portion between the lateral sides thereof. The hollow tubular member prevents the transverse portion from being distorted as the top portion of the wire-like member is bent toward the bottom portion to fold together when the flotation means is to be collapsed. In effect, then, the hollow tubular member acts as a hinge arrangement to keep the transverse portion in place during collapsing and expanding of the flotation means.

A flexible horizontal limit strap may be provided attached to the wire-like members on either lateral side thereof and adjacent the transverse portion to limit the distance the lateral sides can be separated. The horizontal limit strap can be coupled to the hollow tubular member to prevent slipping of the horizontal limit strap along-either lateral side of the wire-like member.

The interior flotation chamber formed by the cover when the flotation means is deployed provides buoyancy for the flotation means due to the trapped air within the flotation chamber. A planar foam strip is located in the flotation chamber between the lower plastic liner and the cover. The foam strip extends the length of the flotation means and has a width approximately equal to the distance between the rounded apices of the base portion of the wire-like member. The foam strip is of a thickness sufficient to provide positive net buoyancy to the flotation means in the event that liquid enters the flotation chamber. In order to permit articulation of the foam strip laterally while remaining planar, wedge-shaped notches are formed in the lateral sides thereof at longitudinal intervals. In effect, this establishes broadly defined pivot points in the region between points of the wedge-shaped notches which are preferably provided on opposite sides of the foam strip.

A flexible vertical limit strap may extend from the top portion of the wire-like member to the center of the base portion thereof. This aids in assembly and in maintaining the proper shape of the wire-like member if external forces, such as those caused by handling or deployment and retrieval of the flotation means are applied to the side surfaces of the flotation means tending to elongate the wire-like fibers vertically.

A pair of ballast bags, attached to the exterior of the cover, one at each rounded apex of the cover bottom and extending the length of the flotation means, may be provided for added stability of the flotation means. Each ballast bag has an enclosed chamber for containing liquid and comprises at least one liquid opening, and preferably a plurality of openings spaced along its length, to permit liquid air to enter/exit and fill/empty the ballast bag chamber. The openings are sized to allow liquid into the ballast bag chamber over a period of time after deployment and to restrict the draining of the ballast bag chamber to a time substantially greater than the time the ballast bags are above the liquid level of the body of liquid due to external forces being applied tending to tip the flotation means laterally and force one of the ballast bags to rise out of the liquid. Depending from the bottom of the flotation means, and running the length thereof, the ballast bags further stabilize the flotation means by acting as stabilizing fins on either side of the flotation means. As desired, the ballast bags can be weighted to insure proper disposition and filling after deployment of the flotation means.

The cover is constructed as a one-piece cover which can be laid out relatively flat on a work surface with its exterior facing downwardly to define first and second longitudinal side edges, after which the skeleton frame is placed at its center, and the first and second side edges are brought up to attach together at or near the top apex of the skeleton frame. Such construction allows for easy access to the internal structure for maintenance and/or cleaning. The attachment of the cover to the apex of the skeleton frame near but not at the top is advantageous, in that the side of the flotation means comprising the cover attachment arrangement can face the non-contaminant side of the body of liquid, leaving a smooth side of the cover facing the contaminant. This lessens the likelihood of contaminant entering the flotation chamber.

For securing the cover to the skeleton frame, there is provided a first velcro strip secured to the outer surface at or near the center of the upper plastic liner and extending the length of the flotation means, and a first mating velcro strip secured to the interior edge of the first longitudinal side edge of the cover, such that when the first longitudinal side edge of the cover is brought up to the top apex, the first velcro strip and the first mating velcro strip bind together. A second velcro strip is secured to the exterior of the first longitudinal side edge of the cover and extends the length of the flotation means. A second mating velcro strip is secured to the interior of the second longitudinal side edge of the cover, such that when the second longitudinal side edge of the cover is brought up to the top apex, the second velcro strip and the second mating velcro strip bind together, thereby completing the covering of the skeleton longitudinally.

Other means for fastening the edges of the cover at the top can be equally effective in securing the cover in place, such as zippers, snaps (dot fasteners), interlocking D-loops on one cover edge and slots on the other cover edge, etc. Also, instead of overlapping the two side edges of the cover, one of the side edges may be Y-shaped in cross section, the arms of which sandwich the opposite edge therebetween, and velcro or other temporary fastening means, as defined herein, holds the sandwiched ends together.

Since each wire-like member is collapsible, the entire flotation means can collapse and be wound around a lightweight, but sturdy, reel for shipment to the deployment area or for convenient storage of the flotation means in a minimum amount of storage space.

In an alternate embodiment of the invention there is provided a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein the flotation means has a large water plane area compared to its top and comprises: a plurality of collapsible wire-like members each having the general shape of the cross section of the flotation means; a relatively stiff lower plastic liner extending the length of the flotation means, the width of the lower plastic liner being wider than the base of the wire-like member; a relatively stiff upper plastic liner, less in width than the lower plastic liner, extending the length of the flotation means. A plurality of elongated mounting strips extend the length of the flotation means, and fastening means are provided for fastening the wire-like members to the mounting strips and the mounting strips to the upper and lower plastic liners at intervals therealong to produce a skeleton frame for the flotation means, with the wire-like members mounted transversely to the mounting strips and between the upper and lower plastic liners. A relatively flexible plastic cover defines contaminant impervious walls completely surrounding and conforming to the shape of the skeleton frame of the flotation means to envelop an inner elongated flotation chamber and provide end walls closing the ends of the chamber, the lateral edges of the lower plastic liner turning up and bending to conform to the shape of the interior of the cover. A planar foam strip is located in the flotation chamber between the lower plastic liner and the cover, the foam strip extending the length of the flotation means and having a width approximately equal to the width of the base portion of the wire-like member.

In a further alternative embodiment of the invention, there is provided a contamination containment boom of the type adapted to contain a contaminant in a preselected location on a body of liquid, the boom having an elongated flotation means adapted to float on the body of liquid, a closed flexible boom cover impervious to said liquid and to said contaminant, and a weighted skirt means depending from the flotation means and extending downwardly a preselected distance into the body of liquid, the improvement wherein said flotation means has a cross section that is wider at its base than at its top, and the flotation means comprises: a pair of ballast bags, attached to the exterior of the cover, one at each lower side of the base and extending the length of the flotation means, said ballast bags positioned on the cover so as to be fully submerged in the liquid when the flotation means is deployed, each ballast bag having an enclosed chamber for containing liquid and comprising liquid openings spaced along its length to permit liquid/air to enter/exit and fill/empty said ballast bag chamber.

In yet a further alternate embodiment of the invention, there is provided a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a large water plane area compared to its top and comprises: a plurality of wire-like members; a relatively stiff upper plastic liner extending the length of the flotation means; a plurality of elongated mounting strips extending the length of the flotation means; fastening means for fastening the wire-like members to the mounting strips at intervals therealong to produce a skeleton frame for the flotation means, with the wire-like members mounted transversely to the mounting strips and the upper stiff plastic liner mounted to the top portion of the wire-like members. A relatively flexible one-piece plastic cover, having first and second longitudinal side edges extending the length of the flotation means, defines contaminant impervious walls completely surrounding and conforming to the shape of the skeleton frame of the flotation means to envelop an inner elongated flotation chamber and provide end walls closing the ends of the chamber, the cover being wrapped about the skeleton frame by laying out the cover on a work surface with its exterior facing downwardly, after which the skeleton frame is placed at its center and the first and second cover side edges are brought up to attach together at the top apex of the skeleton frame. A first velcro strip is secured to the outer surface at the center of the upper plastic liner and extends the length of the flotation means. A first mating velcro strip is secured to the interior edge of the first longitudinal edge of the cover, such that when the first longitudinal edge of the cover is brought up to the top apex, the first velcro strip and the first mating velcro strip bind together. A second velcro strip is secured to the exterior edge of the first longitudinal edge of the cover and extends the length of the flotation means. A second mating velcro strip is secured to the interior edge of the second longitudinal edge of the cover, such that when the second longitudinal edge of the cover is brought up to the top apex, the second velcro strip and the second mating velcro strip bind together, thereby completing the covering of the skeleton longitudinally.

BRIEF DESCRIPTION OF THE DRAWING

The above and other embodiments of the present invention may be more fully understood from the following detailed description, when taken together with the accompanying drawing wherein similar reference characters refer to similar elements throughout, and in which.

DETAILED DESCRIPTION OF THE PREFERRED EMBODIMENTS

Figure 1:
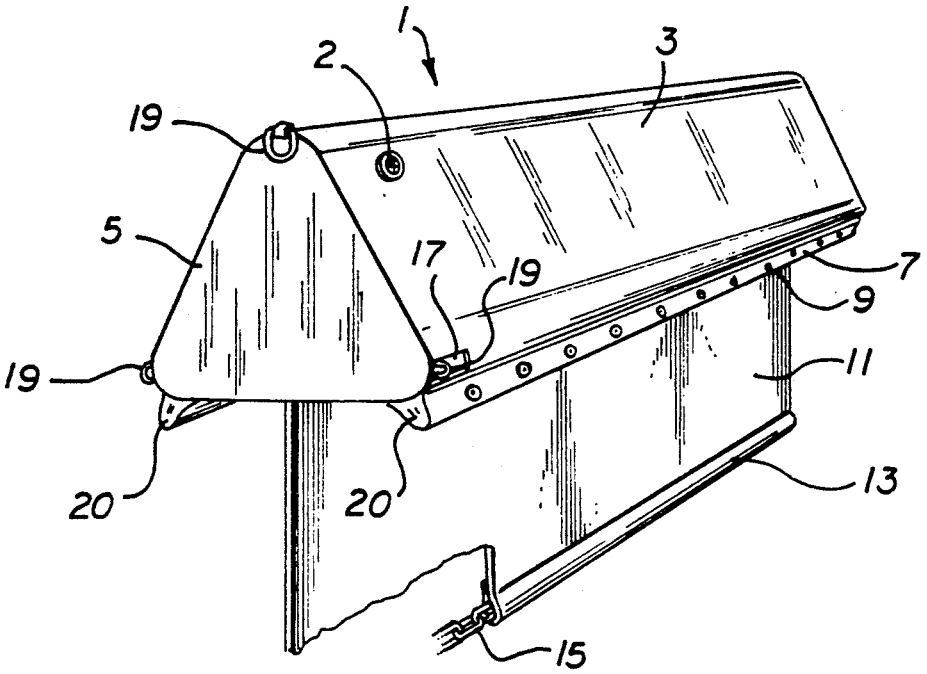
FIG. 1 is a perspective view, in partial section, of a preferred embodiment of the present invention.

Referring now to the drawing, FIG. 1 illustrates a perspective view of the invention in the deployed condition. As with other contaminant control boom arrangements, the needed length of the containment boom is realized by assembling a series of individual boom sections in train-like fashion, and FIG. 1 shows one such section incorporating the features of the present invention. The contaminant barrier or boom section 1 comprises an elongated flotation means 3 within endwalls 5. A breather hole means 2 provides an air vent to allow aspiration of air into and out of the interior chamber 4 (see also FIG. 2), the breather hole means 2 being located at or near the top of the flotation means 3. A screen 10 may be positioned in the air passageway of breather hole means 2, if desired.

Figure 2:
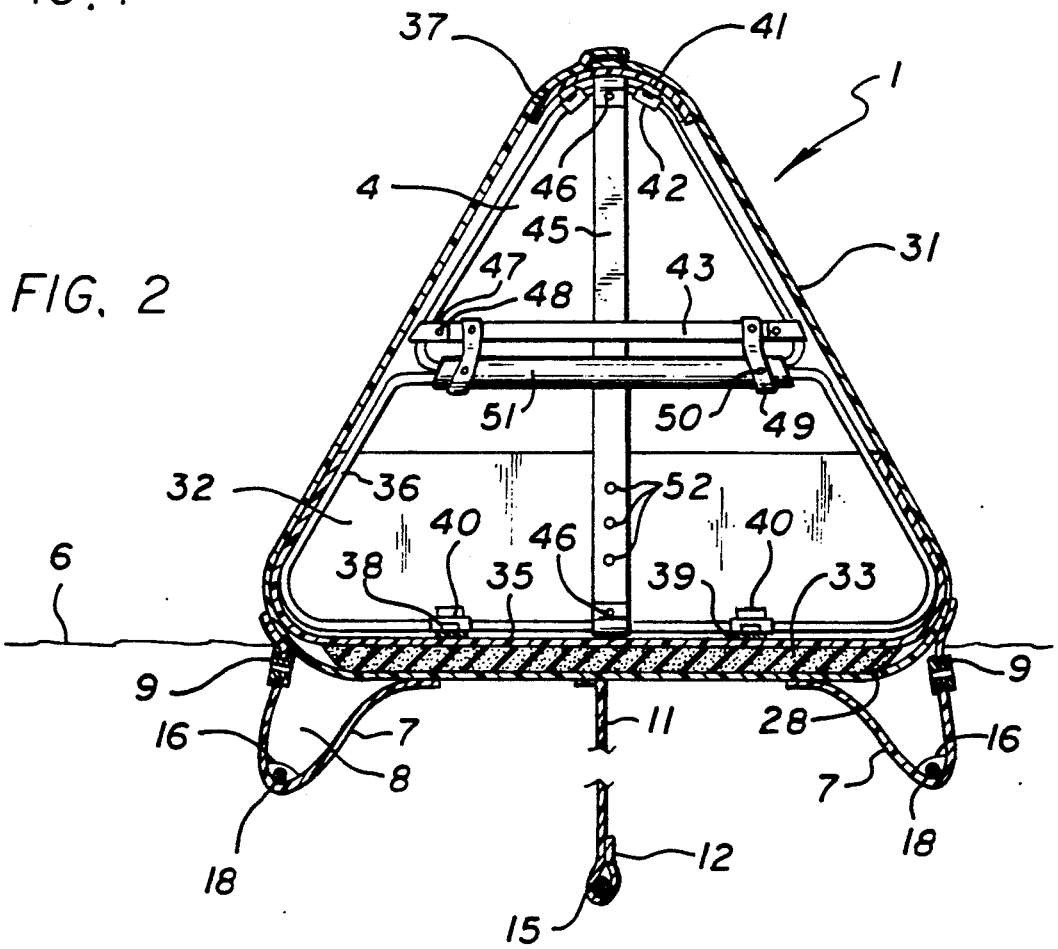
FIG. 2 is a sectional view of the embodiment shown in FIG. 1.

A pair of depending ballast bags 7 are attached on either side of the flotation means 3 and contain openings 9 to permit air and/or liquid to flow into and out of the ballast bag chamber 8, as better seen in FIG. 2. The ballast bags 7 provide significant stability to the flotation means 3 in two important ways. First, after the flotation means 3 is deployed in the body of liquid, the ballast bag chambers 8 fill with the liquid within a few minutes due to the liquid seeping through the openings 9 to fill the chambers 8. For insuring that the ballast bags 7 will fill, they can be provided with a length of lead wire or other weighted material, and if it is in a wire form it can be threaded through a sleeve of netting attached to the lower inner surface of the bags 7. When external forces, such as wind and/or high waves tend to tip the flotation means 3 in a rotational movement about its axis, one or the other of the ballast bags 7 will rise out of the liquid, and the weight of the elevated ballast bag tends to return the flotation means 3 to its normal deployed condition due to gravity acting on the weight of the liquid in the elevetated ballast bag. Secondly, when in use, the bags hang down vertically in the water preferably about 4" to 8" and act as stabilizer fins resisting lateral movement of the flotation means 3.

The openings 9 are designed to have an opening large enough to permit the liquid to enter the ballast bag chambers 8 (FIG. 2) within a few minutes from deployment, but small enough to restrict passage of liquid out of the ballast bag chambers 8 when the external tipping forces are applied. Advantageously, the openings 9 are positioned on the outside and near the top of the chamber 8 in order to be in a position less subject to discharge of liquid from within chamber 8 when flotation means 3 is elevated. Of course, the openings 9 permit draining of the ballast bag chambers when the boom section is retrieved from the liquid and prepared for storage. The ends of the ballast bags are preferably sealed with a removable end cap 20 so as to permit liquid to flow into and out of the ballast bag chambers 8 only through openings 9, except upon retrival, when a large opening on the end may be employed for rapid draining or flush cleaning. In this respect, end caps 20 are removably or releasably secured to the ends of each ballast bag 7 by zipper means, velcro strips, snaps, or other known releasable fastener (not shown) to allow large area access into the ends of bags 7 for quick release of liquid/contaminant from the bags 7 preparatory to storage of the flotation means 3, or for flushing out or otherwise cleaning out the bag chamber 8.

A depending flexible skirt 11 extends from the lower portion of the flotation means 3 a predetermined distance below the surface 6 (FIG. 2) of the liquid. In general, the flexible skirt 11 is of known configuration, extends the length of the flotation means 3, and is provided with a pocket-like portion 15 at the lower edge thereof. In the pocket-like portion 15, there may be provided a ballast weight 32 which may take the form of a chain, as illustrated, or a cable, or other similar device serving both as a ballast member and as a tension member.

Reinforcement patches 17 may be applied at the apices of a flotation means 3 which provide locations for mounting attachment means 19. They which may be in the form of D-rings, to be used when manipulating the boom section 1 or when connecting boom section 1 to other adjacent boom sections. These attachment means 19 may also be used to attach a towing nose or towing tail to the end sections of a long boom for transporting the boom on the liquid surface or for putting the boom in tension.

Figure 3:
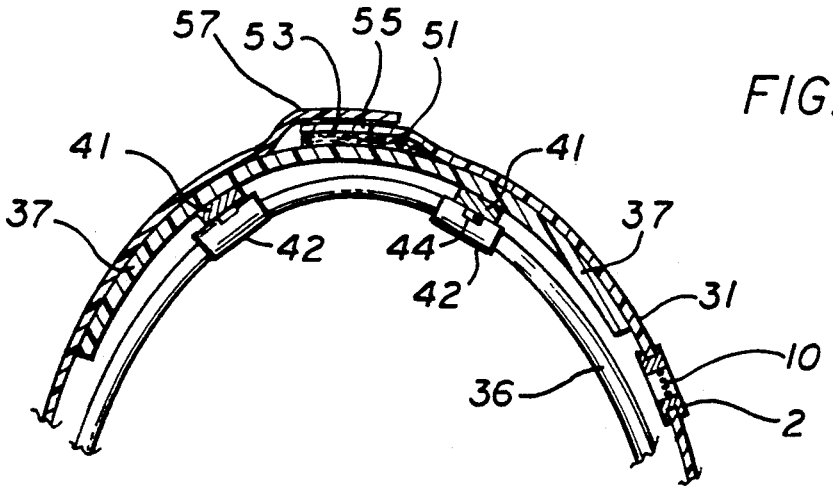
FIG. 3 is a sectional view of the top portion of the invention as shown in FIG. 2.

Turning now to FIGS. 2 and 3, a cross section of the flotation means 3 is shown in detail. An elongated plastic cover 31 is shown as a continuous sheet of material attached at the top of the flotation means by overlapping edge portions of the cover 31. A foam strip 33 is positioned in the center of the cover 31 and extends the length of the flotation means. The longitudinal side edges 28 are shown bevelled to conform with the rounded corners of the cover bottom.

On top of the foam strip 33 is a lower plastic liner 35 made of stiffer plastic than that of the flexible cover. The lower plastic liner 35 extends the full length of the flotation means and has a width wider than the distance between the lateral bottom corners of the flotation means 3. A plurality of spaced ribs, preferably in the form of wire-like members 36, having a generally triangular form, but which may have other forms for which the bottom has a large water plane area, are attached to the lower plastic liner 35 as well as to an upper plastic liner 37 by mounting means to be described.

The plurality of wire-like members 36 are arranged axially along the flotation means 3 to provide a skeleton framework for the boom section about which the cover 31 is wrapped. Accordingly, it is necessary to mount the wire-like members into a framework which is sufficiently strong to maintain the generally triangular shape of the flotation means and yet permit flexibility of the boom section 1 in both the vertical and the horizontal directions. Toward this end, a pair of bottom metal mounting strips or bands 39 are laid down lengthwise of the flotation means 3 on either side of the center of the lower plastic liner 35. Fastener straps 40 are then wrapped around the bottom side of each wire-like member 36, and rivets 38 are inserted to fasten the wire-like member to the bottom mounting strips 39 by means of fastener straps 40, and in turn, to fasten the bottom metal mounting strips 39 to the top surface of the lower plastic liner 35. No attachment need be made to the foam strip 33 which is sandwiched between the bottom of the lower plastic liner 35 and the interior surface of the cover 31.

A similar mounting arrangement is provided at the top of the flotation means 3 in which the wire-like member 36 is fastened to a pair of top metal mounting strips or bands 41 by means of a fastener strap 42, and, in turn, the top metal mounting strips 41 are attached to the lower side of the upper plastic liner 37 by means of rivets 44 as best seen in FIG. 3.

A flexible vertical limit strap 45 is attached from the top to the center of the bottom of the wire-like member 36 to restrain the geometrical configuration to a maximum height to assure the range and direction of hinge action of the wire-like member 36. Vertical limit straps 45 are shown secured to the wire-like member 36 by wrapping the ends thereof about the wire-like member and riveting the overlapped ends in place b rivets 46.

Figure 4A:
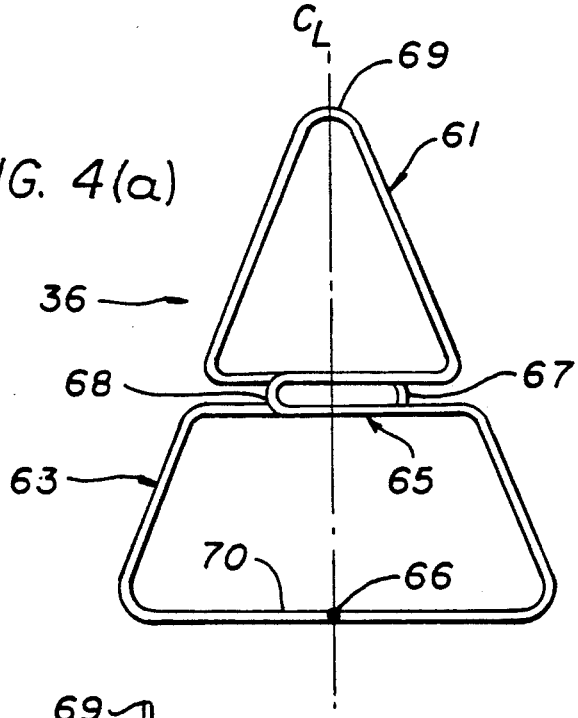
FIG. 4 is an elevation view of one of the wire-like members comprising the skeleton framework for the present inventions a front view shown in FIG. 4(*a*), and a side cross sectional view, taken along the dashed line $C_L$ shown in FIG. 4(*b*)
Figure 4B:
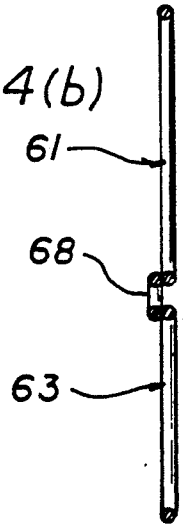

As best seen in FIG. 4, the wire-like member 36 preferably has a continuous looped configuration defining a top portion 61, a base portion 63, and transverse portion 65. The transverse portion 65 consists of U-shaped prolongations of each lateral side extending past the vertical center line $C_L$ of the member 36 forming abrupt reverse bends 67 and 68. Member 36 can be formed of a continuous wire-like body welded along the bottom length 70 at weld 66. A cross sectional view of the wire-like member 36 taken along center line $C_L$ is shown in FIG. 4(*b*).

Figure 5A:
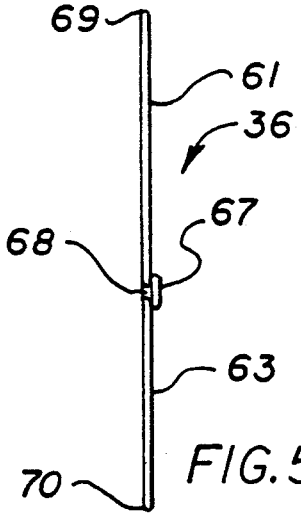
FIG. 5 shows a side elevation view of the wire-like member of FIG. 4 in three positions ranging from fully expanded to a collapsed state in the three views (a)–(c)
Figure 5B:
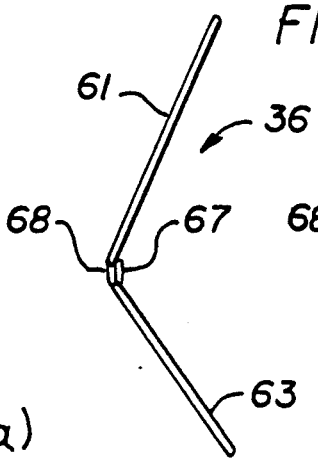
Figure 5C:
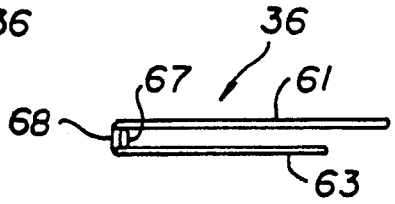

The purpose for the transverse portion 65 is to permit the top portion 61 to fold toward the base portion 63 to thereby put the transverse portion 65 into torsion. This action is shown in FIG. 5 where FIG. 5(*a*) shows the fully extended configuration of member 36, FIG. 5(*b*) shows the intermediate condition, and FIG. 5(*c*) shows the completely folded or collapsed condition of the member 36. Because the cover 31, vertical limit strap 45, bottom and top metal mounting strips 39,41 and lower and upper plastic liners 35,37 are all flexible, the entire body of the flotation means 3 can collapse along with the collapsing of each wire-like member 36 which comprises the main vertical elements of the skeleton framework for the flotation means 3. The fully collapsed flotation means 3 can then be stored on a reel 81 and transported conveniently by rolling it or by a carrying pole slipped through the center hole 83.

While various configurations for wire-like member 36 can be fashioned to produce a transverse portion such as that shown at 65, the configuration shown in FIG. 4 is simple, easy to manufacture, and requires no assembly or welding at the point of usage when the skeleton framework is assembled. There are other forms of support arrangements providing resilient resistance to bending movement provided by a transverse section in a portion of the arrangement, such as that shown and described in U.S. application Ser. No. 06/410,854, filed Aug. 23, 1982 and entitled "RESILIENT TORSION ARRANGEMENT".

With the configuration of wire-like member 36, which may more technically be referred to as a wire-like torsion lifter, the action of folding and unfolding can cause the transverse portion 65 to depart from its normal quiescent position. To hold the transverse portion (or portions) 65 in place, a hinge tube 51 is used. Hinge tube 51 can be cut from standard PVC plastic pipe and can have its ends taper cut to match the slope of the lateral sides of the flotation means 3, as seen in FIG. 2. In this same Figure, there is shown a convenient way of holding horizontal limit strap 43 in its position preferably adjacent the transverse portion of the wire-like member 36. Horizontal limit strap 43 is of a length sufficient to wrap each of its ends around respective sides of wire-like member 36 and form loops 47 which are, in turn, held in place by rivets 48. A tube holder strap 49 is then riveted by rivets 50 to the hinge tube 51 at one end and to the horizontal limit strap 43 at the other end by means of rivets.

The manner in which cover 31 is held in place at the top of the flotation means 3 is shown in FIG. 3. In FIG. 3, two lengths of velcro 51 and 53 are shown. Each length of velcro, in practice, comprises two parts, a hook part and a loop part, as is commonly known. In this description, for convenience, the same reference numeral is used to designate both parts of a length of velcro with the two parts further being referred to as a and b parts. Also, one of the parts, e.g. part a, is referred to as a velcro strip, while the other part, e.g. part b is referred to as a mating velcro strip. In FIG. 3, a first velcro strip 51*a* is secured to the outer surface at the center of the upper plastic liner 37 and extends the length of the flotation means 3. A first mating velcro strip 51*b* is secured to the interior edge of the first longitudinal edge 55 of cover 31, such that when the first longitudinal edge 55 is brought up to the top apex, the first velcro strip 51*a* and first mating velcro strip 51*b* bind together. A second velcro strip 53*a* is secured to the exterior edge of the first longitudinal edge 55 of cover 31 and extends the length of the flotation means. A second mating velcro strip 53*b* is secured to the interior edge of a second longitudinal edge 57 of cover 31, such that when the second longitudinal edge 57 is brought up to the top apex, the second velcro strip 53*a* and second mating velcro strip 53*b* bind together, completing the secure covering of the skeleton framework longitudinally.

Figure 6A:
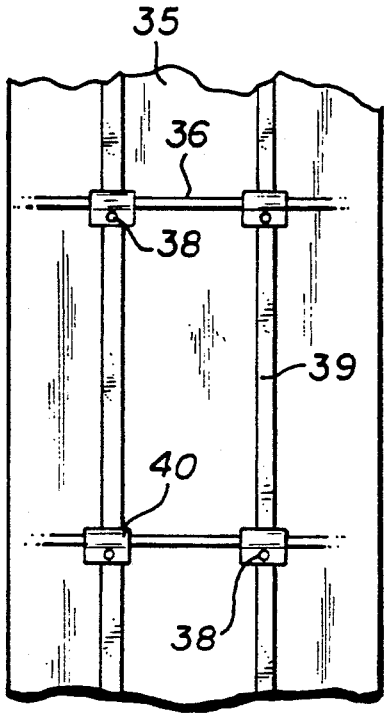
FIG. 6 shows of the lower plastic liner with mounting strips attached thereto shown in plan view (a) and edge view (b)
Figure 6:
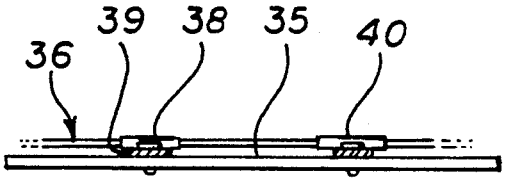

FIGS. 6(*a*) and 6(*b*) show the construction of the lower plastic liner 35 which has bottom mounting strips 39 attached thereto by means rivets 38. Shown in FIG. 6 are the fastener straps 40 and wire-like member 36 which have been described earlier in this description. These elements are shown with wire-like member 36 depicted partially in phantom.

Figure 7:
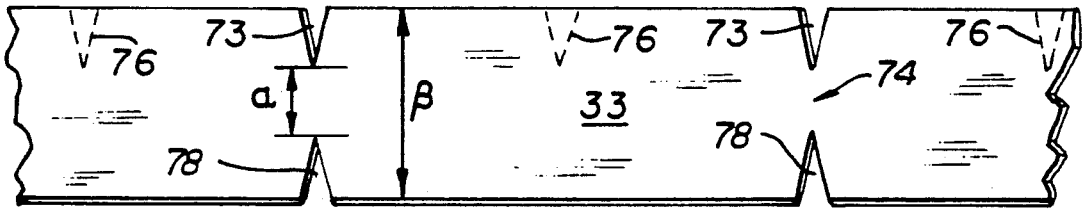
FIG. 7 shows a length of the foam strip situated at the bottom of the flotation means according to the invention.
Figure 8:
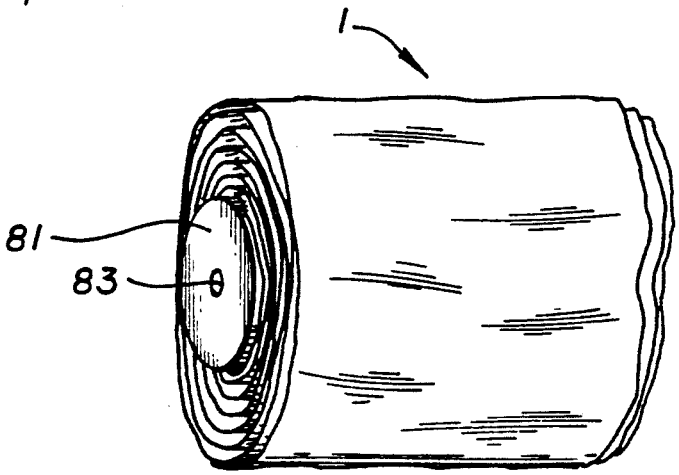
FIG. 8 shows the invention in collapsed and stored condition wound on a reel.

FIG. 7 illustrates a preferred arrangement of the foam strip 33 in which notches 73,78 are cut into opposite sides of the strip 33 so as to permit horizontal articulation or pivoting of one segment of strip 33 relative to the adjacent segment at a pivot point 74. It has been found in practice that sufficient articulation, about pivot point 74 may be realized using a distance $\alpha = 6''$ to $12''$ for a $2\frac{1}{4}''$ thick foam strip 33 having a width $\beta$ of $24''$. Fracturing at pivot points 74 caused by bending fatigue can be lessened by locating the notches 78 on one edge of strip 33 alternately spaced with respect to notches 76 (shown in phantom) on the opposite edge of strip 33.

One of the important features of the present invention is the ease of construction and assembly. This has already been suggested by the convenient way the skeleton framework is constructed and the way the cover 31 is attached making it easily removable for replacement or for performing maintenance on the interior of the flotation means 3. In this vein, it should be appreciated that the foam strip 33 need not be glued or otherwise attached to the lower plastic liner 35 or to the cover 31. Similarly, the lower and upper plastic liners 35, 37 need not be glued or otherwise permanently attached to the cover 31.

The height of the flotation means, depending on prospective use, can range from 20" to 60" and would typically be about 40". For the 40" high model, the wire-like torsion lifter members 36 are preferably spaced lengthwise of the flotation means about 44" apart and made of corrosion resistant steel about 5/16" in diameter. The bottom and top metal mounting strips 39, 41 are preferably made of corrosion resistant steel bands 1/16" thick and 1" wide. The strips 39, 41 are flexible enough to buckle when the flotation means articulates laterally in use.

The relatively stiff lower and upper plastic liners 35,37 are preferably constructed of low-density polyethylene about 0.040" to 0.060" thick. The flexible plastic cover 31 is plastic-coated nylon, polyester, or the like. The foam strip 33 can be formed from closed cell polyethylene having a density in the range of 1 to 4 lb./ft$^3$, preferably about 2 lb./ft$^3$. The horizontal and vertical limit straps 43,45 can be made of the same material as the cover 31.

Figure 9:
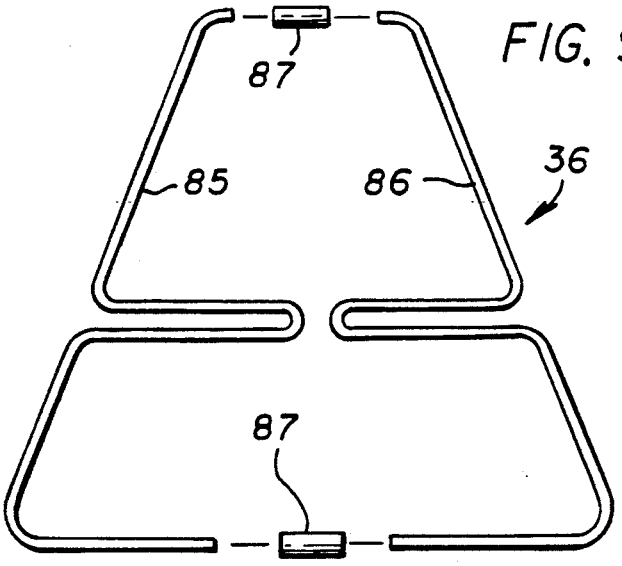
FIG. 9 shows an exploded view of an alternate form of the wire-like members comprising the skeleton frame for the present invention.

An alternative construction of the wire-like member 36 is shown in FIG. 9 in which the wire-like body is comprised of two halves 85 and 86. Couplers 87 couple the free ends of each half to those of the other half and can fix the free ends together by an interference fit, crimping, welding, or other like techniques.

Figure 10:
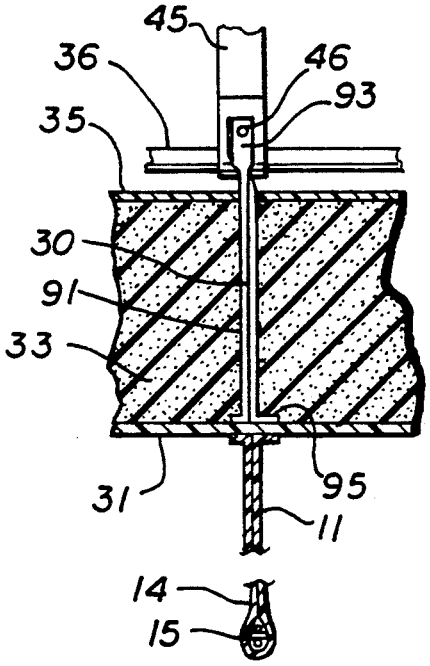
FIG. 10 shows a cross section of the base of the invention with a plastic support strap connected between a wire-like member and the cover.

In use, and especially in view of the lack of adhesive or fixation between the cover 31 and the bottom of the foam strip 33, the bottom of cover 31 could droop due to the downward pull of skirt 11 and thus disadvantageously create an air pocket beneath foam strip 33. To prevent this, means are provided for connecting the inside bottom of cover 31 to the wire-like member 36 as shown in FIG. 10. A short strap 91, made of the same material as cover 31, is fixed to the inner surface of cover 31 by folding the lower ends to form tabs 95 attached opposite the point of attachment of the skirt 31, or may even consist of extensions of the material of skirt 11 itself. The specific arrangement of FIG. 10 is thus not exclusive. The upper end 93 of strap 91 is held in place by rivet 46. The strap 91 can be simply forced through the soft foam strip 33 making a hole 30 therein and similarly punched through lower plastic liner 35.

Figure 11:
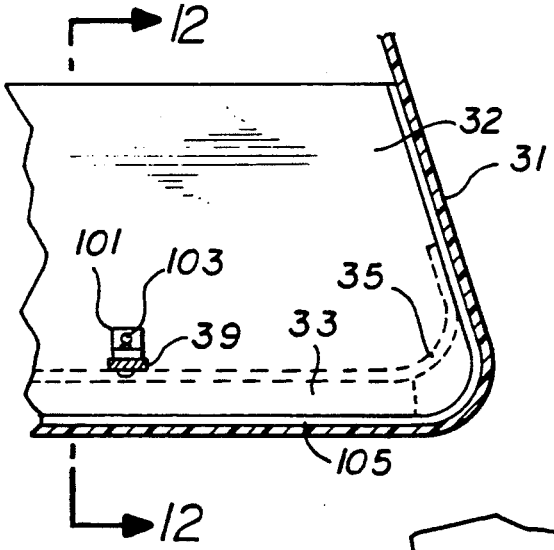
FIGS. 11 and 12 show a bulkhead arrangement and apparatus for holding the mounting straps in place, FIG. 12 being a view taken along the line 12—12 in FIG. 11.
Figure 12:
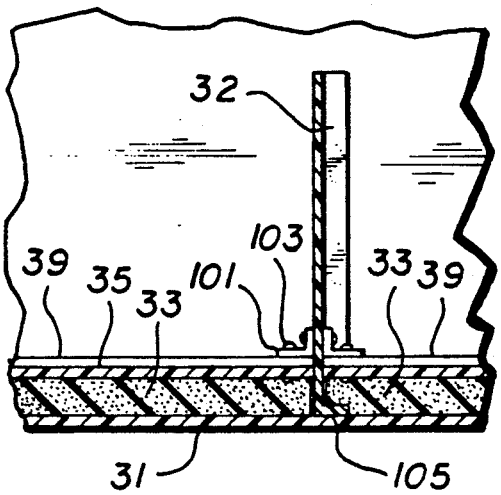

It may be advantageous to block off segments of flotation means 3 to keep any liquid that does enter flotation chamber 4 somewhat confined. This arrangement stabilizes the flotation means 3 by restricting the movement of any liquid which may have intruded and prevent such entrapped liquid from sloshing about the length of the flotation means. Such design also permits easier emptying of any captured liquid and simplifies and expedites cleaning when preparing the flotation means 3 to be retrieved and stored after usage. Toward this end, a bulkhead 32 is attached to the cover 31 in a liquid tight seal at the bottom and partially up the walls of cover 31 to any height, but preferably to about one-third the height of the flotation means 3, as shown in FIGS. 11 and 12. Because of the need to create the liquid tight seal, it is necessary, for this alternate embodiment of the invention, to break up the foam strip 33, the bottom metal mounting strips 39, and the lower plastic liner 35 into discontinuous longitudinal segments. The foam strip 33 and liner 35 can simply be cut to fit the length of the segments between bulkheads 32 which are placed every two or three wire-like members apart, the wire-like members being spaced about 2 to 4 feet apart. The metal mounting strips 39, however, should be kept intact lengthwise of the flotation means 3 to maintain the structural integrity thereof. To accomplish this, a pair of short angle brackets 101 are riveted, by rivets 103, to the ends of metal strips 39 on each side of bulkhead 32 and also riveted to one another through bulkhead 32 as show in FIG. 12. Although the rivets 103 provide a good liquid seal (near seal) on their own, a sealing substance could be applied to the facing surfaces of the angle brackets 101 before installation, or some curable sealing material could be applied to cover each rivet after assembly. For added support, the bulkheads could be secured to either the hinge tube 51 or, as shown in FIG. 2, to the vertical limit strap 45, by rivet means 52. Other mechanical arrangements could also be used, such as a flat coupling plate (not shown) forced through the bulkhead 32 and riveted to the ends of metal strips 39 and a sealing substance applied around the hole in the bulkhead 32 around the coupling plate. The specific arrangement of FIG. 11 and 12 is thus not exclusive.

Figure 13:
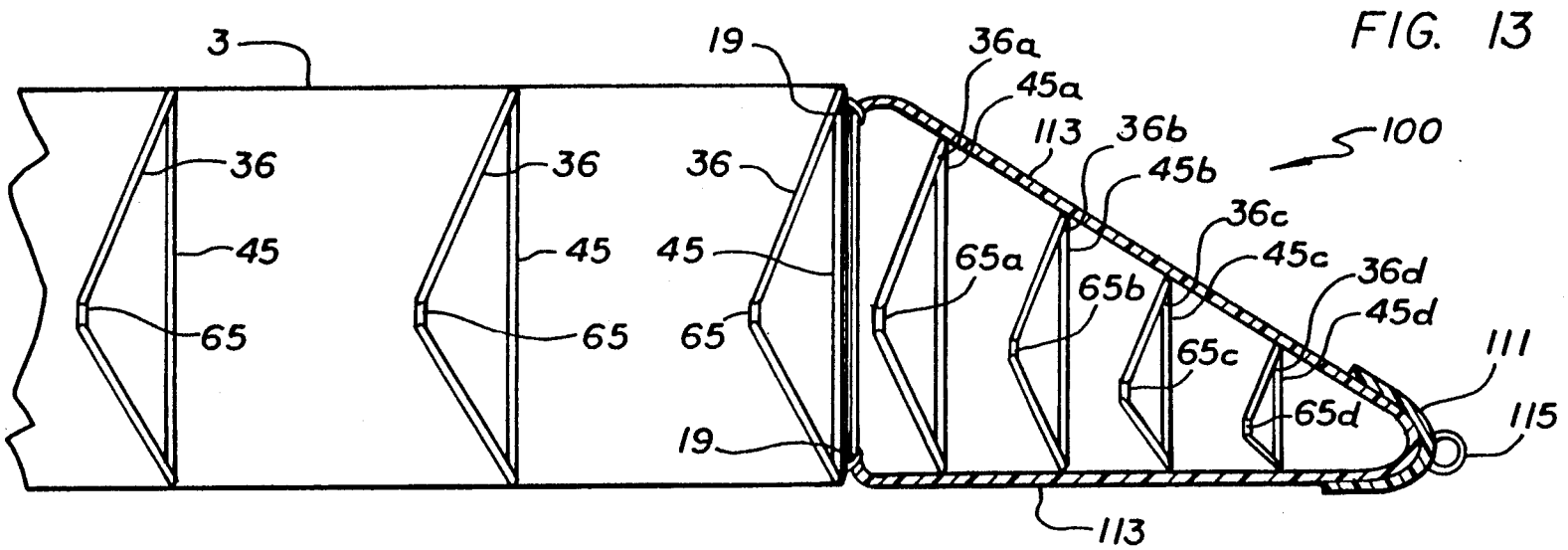
FIG. 13 shows schematically the adaption of the invention to a towing nosepiece.

In FIG. 13, there is shown a schematic representation of the invention applied to the construction of a towing nose 100 comprised of a series of progressively smaller torsion lifters, i.e. wire-like members, 36, 36*a*, 36*b*, 36*c*, and 36*d*, showing the position of corresponding transverse portions 65, 65*a*, 65*b*, 65*c*, and 65*d*. The towing nose 100 attaches to the flotation means 3 by attachment means 19 and has a nose reinforcement member 111 with a towing ring 115 firmly secured thereto for connection to a towing vessel or ship. Any of a variety of reinforcement structures 113, such as nylon rope or strapping, metal wire cable, etc. can be used to strengthen the towing nose 100 and yet permit collapsing for storage on a reel the same as is done with the flotation means 3 discussed earlier. In order to experience lifting force by wire-like members 36 after the flotation means 3 is fully deployed (inflated), the length of vertical limit straps 45 for each wire-like member can be of a length to prevent the wire-like members from fully opening, as shown in FIG. 13. This adds rigidy and stability to the deployed flotation means 3.

Figure 14C:
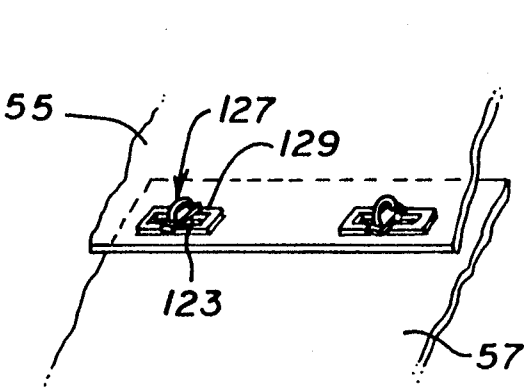
FIGS. 14(*a*)–(*c*) show variations in the securing of the cover edges at the top of the flotation means.
Figure 14B:
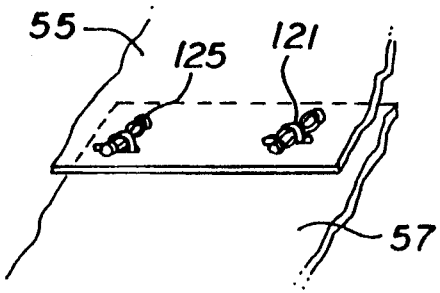
Figure 14A:
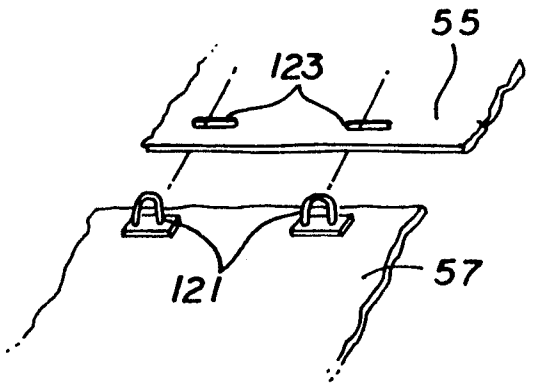

FIG. 14 shows a variety of alternate means for attaching the edges of the cover 31 at the top of the flotation means 3. Instead of velcro, D-rings 121 and slots 123 (FIG. 14(*a*)) may be secured in place by a retainer such as a cable, clasp, pins, or the like, pins 25 being shown in FIG. 14 as representative. Alternatively, the D-rings can be of the swivel type 127 passing through slots 123 reinforced by plastic strips or metal plates 129.

Figure 15:
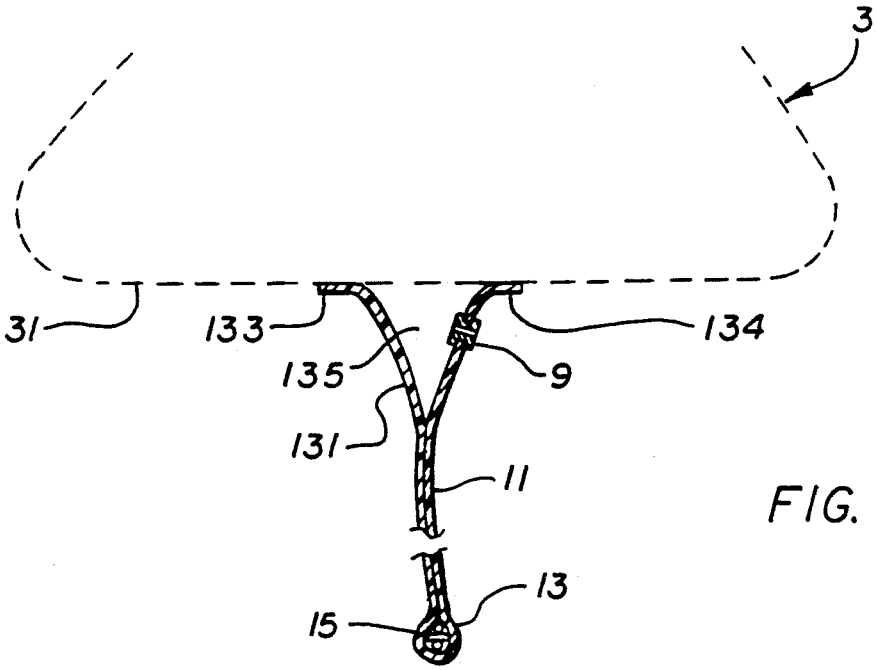
FIG. 15 shows the main body of the flotation means in phantom and an alternate ballast bag arrangement.

FIG. 15 shows the flotation means 3 and cover 31 in phantom and an alternate ballast bag arrangement. In this embodiment, the top 131 of the skirt 11 is divided, separated, and attached at 133 and 134 to define a ballast bag chamber 135 having at least one opening 9. Although lacking the rotational stability of the embodiment shown in FIGS. 1 and 2, the weight of liquid in chamber 135 gives a significant ballast effect, and is simpler and less expensive to manufacture.

Figure 16:
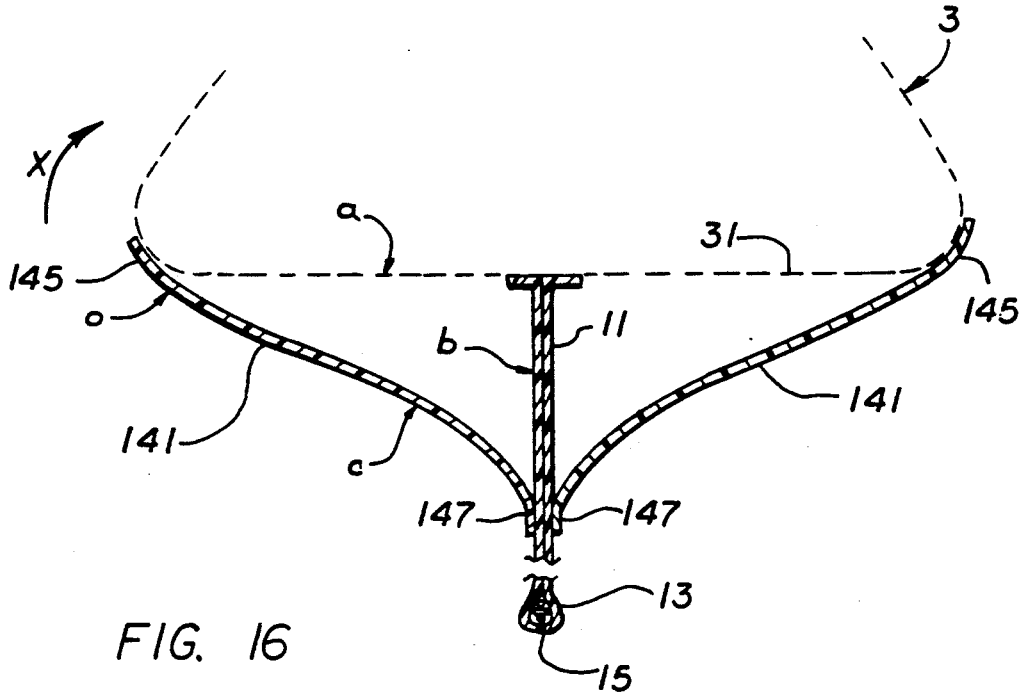
FIG. 16 shows an embodiment without ballast bags and with hypotenusal ties attached between the cover and skirt.

In addition to, or alternate to, the use of ballast bags, hypotenusal ties 141 may be employed to stabilize, or further stabilize as the case may be, the flotation means 3, as shown in FIG. 16. There, a skirt 11 is shown depending from the bottom of cover 31, as before. In this figure, however, hypotenusal ties 141 link the bottom apices of cover 31 with a point on skirt 11 spaced from the bottom of cover 31 to form a right triangular structure abc. As external forces tend to tip flotation means 3 clockwise (in the direction of arrow X), the apex o elevates. The hypotenusal tie 141, being attached to apex o at one end 145 and to the skirt 11 at the other end 147, will apply a resistant force along hypotenuse c downwardly toward attachment point 147 due to the weight of the skirt 11 and chain 15 and by the fact that chain 15 will normally be in tension providing an additional hold-back force along hypotenuse c. The length of triangle side b is chosen based upon the physics and geometry of the flotation means 3/skirt 11 design. Hypotenusal ties 141 are located on each lateral side of the flotation and may comprise a plurality of longitudinally spaced plastic straps, nylon rope, or other flexible elements, or may comprise a nylon netting material, or the like, linking the skirt 11 with the apices of the flotation means 3.

This concludes the description of the preferred embodiments of the invention. Those skilled in the art may find many variations and adaptations thereof, and all such variations and adaptations, falling within the true scope and spirit of the invention, are intended to be covered thereby.

I claim:

1. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top with rounded apices at each side of said bottom and at said top, and said flotation means comprises:

a plurality of wire-like members each having the general shape of the cross section of said flotation means with corresponding rounded apices, a side of each wire-like member defining a base portion and the lateral sides extending upwardly from said base portion meeting at an apex opposite said base portion to define a top portion, a transverse portion extending from at least one of said lateral sides toward the opposite lateral side of said wire-like member;

a relatively stiff lower plastic liner extending the length of said flotation means;

a relatively stiff upper plastic liner, less in width than said lower plastic liner, extending the length of said flotation means;

a plurality of elongated mounting strips extending the length of said flotation means;

fastening means for fastening said wire-like members to said mounting strips and said mounting strips to said upper and lower plastic liners at intervals therealong to produce a skeleton frame for said flotation means, with said wire-like members mounted transversely to said mounting strips and between said upper and lower plastic liners, said upper plastic liner being fastened at said top portion of each said wire-like member, and said lower plastic liner being fastened at said base portion of each said wire-like member; and a relatively flexible plastic cover defining contaminant impervious walls completely surrounding and conforming to the shape of said skeleton frame of said flotation means to envelop an inner elongated flotation chamber and provide end walls closing the ends of said chamber.

2. The apparatus as claimed in claim 1, wherein:

one end of each said transverse portion of said wire-like member is connected to said top portion; and the other end of said transverse portion is connected to said base portion;

thereby allowing said top portion to fold down toward said base portion to put said transverse portion into torsion, and enabling said skeleton and, in turn, said flotation means to collapse.

3. The apparatus as claimed in claim 2, wherein said transverse portion is U-shaped.

4. The apparatus as claimed in claim 2, wherein said wire-like member is a continuous loop running from the center of said base portion, around one base apex and up said one lateral side to a predetermined distance from said top portion, then transversely toward said opposite lateral side, around a sharp reverse bend, back transversely toward said one lateral side, then upwardly and around the top apex to form said top portion, then downwardly to a predetermined distance from said base portion, then transversely toward said one lateral side, around a sharp reverse bend, back transversely toward said opposite lateral side, then downwardly, around the other base apex, and back to the center of said base portion, each part of said wire-like member which runs transversely, exclusive of said base portion, defining said transverse portion.

5. The apparatus as claimed in claim 3, comprising:

a hollow tubular member surrounding said transverse portion of said wire-like member and extending substantially the length of said transverse portion between said one lateral side and said opposite lateral side of said wire-like member.

6. The apparatus as claimed in claim 3, comprising:

a flexible horizontal limit strap the ends of which are attached to said wire-like member on said lateral sides thereof and adjacent said transverse portion to limit the distance said lateral sides can be separated.

7. The apparatus as claimed in claim 6, comprising:

means for preventing slipping of said horizontal limit strap along each lateral side of said wire-like member.

8. The apparatus as claimed in claim 1, comprising:

a planar foam strip located in said flotation chamber between said lower plastic liner and said cover, said form strip extending the length of said flotation means and having a width approximately equal to the distance between the rounded apices of said base portion of said wire-like member.

9. The apparatus as claimed in claim 8, wherein:

said foam strip is of a thickness sufficient to provide positive net buoyancy to said flotation means in the event that liquid enters said flotation chamber.

10. The apparatus as claimed in claim 8, wherein said foam strip comprises:

means forming wedge-shaped notches in the lateral edges thereof at longitudinal intervals to permit articulation of said foam strip laterally while remaining planar.

11. The apparatus as claimed in claim 10, wherein said wedge-shaped notches are provided in pairs, the notches of each pair being oriented opposite one another laterally of said foam strip.

12. The apparatus as claimed in claim 1, comprising:

a flexible vertical limit strap extending from said top portion of said wire-like member to the center of the base portion thereof.

13. The apparatus as claimed in claim 1, comprising:

a pair of ballast bags, attached to the exterior of said cover, one at each rounded apex of the cover bottom and extending the length of said flotation means, each ballast bag having an enclosed chamber for containing liquid and comprising at least one opening to permit liquid to enter and fill said ballast bag chamber.

14. The apparatus as claimed in claim 13, including a plurality of liquid openings spaced along the length of each ballast bag, wherein said liquid openings are sized to allow liquid into said ballast bag chamber over a period of time and to restrict the draining of said ballast bag chamber to a time substantially greater than the time said ballast bags are above the liquid level of the body of liquid due to external forces tending to tip said flotation means laterally and force one of said ballast bags to rise out of the liquid.

15. The apparatus as claimed in claim 1, wherein said cover is constructed as a one-piece cover which can be laid out substantially flat on a work surface, with its exterior facing downwardly, said cover having first and second longitudinal edges extending the length of said flotation means, after which said skeleton frame is placed at its center, and said first and second edges are brought up to attach together at or near the top apex of said skeleton frame, said apparatus further comprising:

a first velcro strip secured to the outer surface at or near the center of said upper plastic liner and extending the length of said flotation means;

a first mating velcro strip secured to the interior edge of said first longitudinal edge of said cover, such that when said first longitudinal edge of said cover is brought up to said top apex, said first velcro strip and said first mating velcro strip bind together;

a second velcro strip secured to the exterior edge of said first longitudinal edge of said cover and extending the length of said flotation means; and a second mating velcro strip secured to the interior edge of said second longitudinal edge of said cover, such that when said second longitudinal edge of said cover is brought up to said top apex, said second velcro strip and said second mating velcro strip bind together, completing the covering of said skeleton longitudinally.

16. The apparatus as claimed in claim 1, comprising air vent means to allow the aspiration of air into and out of said flotation chamber, said air vent means located near the top apex of said cover.

17. The apparatus as claimed in claim 2, in combination with a lightweight but sturdy reel upon which said flotation means can be rolled after it is collapsed.

18. The apparatus as claimed in claim 1, wherein:

said lower plastic liner is wider than said base portion of said wire-like member;

the longitudinal side edges of said lower plastic liner turn up and bend to conform to the rounded apices of the interior of said cover; and the longitudinal side edges of said upper plastic liner turn down and bend to conform to the rounded top apex of the interior of said cover.

19. The apparatus as claimed in claim 8, comprising:

a plurality of spaced bulkheads spanning across and sealed with the interior surface at the bottom and partially up the interior sides of said cover, and wherein:

said bulkheads define separate segments of said flotation means on either side of and between said bulkheads;

said foam strip is comprised of foam strip segments each fitting in one of said flotation segments;

said lower plastic liner is comprised of plastic liner segments each fitting in one of said flotation segments;

each said elongated mounting strip is comprised of mounting strip segments each fitting in one of said flotation segments; and wherein said apparatus includes means for rigidly coupling the end of one said mounting strip in one flotation segment to an adjacent end of the mounting strip in an adjacent flotation segment.

20. The apparatus as claimed in claim 1, wherein each one of a consecutive group of said wire-like members is of a different size to define progressively smaller wire-like members from one end of said consecutive group to the other, thereby forming a flotation towing nose means for said flotation means.

21. The apparatus as claimed in claim 20, in combination with at least one other of said flotation means in which said wire-like members are all of the same size, and further comprising means for connecting said flotation towing nose means to said at least one other flotation means to comprise a flotation boom arrangement.

22. The apparatus as claimed in claim 8, further comprising a plurality of support straps at points along the length of said cover opposite the attachment points of said skirt, each said support strap passing through said foam strip and said lower plastic liner and connected to said base portion of a corresponding wire-like member.

23. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top with rounded apices at each side of said bottom and at said top, and said flotation means comprises:

a plurality of collapsible wire-like members each having the general shape of the cross section of said flotation means with corresponding rounded apices;

a relatively stiff lower plastic liner extending the length of said flotation means;

a relatively stiff upper plastic liner, less in width than said lower plastic liner, extending the length of said flotation means;

a plurality of elongated mounting strips extending the length of said flotation means;

fastening means for fastening said wire-like members to said mounting strips and said mounting strips to said upper and lower plastic liners at intervals therealong to produce a skeleton frame for said flotation means, with said wire-like members mounted transversely to said mounting strips and between said upper and lower plastic liners, said upper plastic liner being fastened at said top portion of each said wire-like member, and said lower plastic liner being fastened at said base portion of each said wire-like member; and a relatively flexible plastic cover defining contaminant impervious walls completely surrounding and conforming to the shape of said skeleton frame of said flotation means to envelope an inner elongated flotation chamber and provide end walls closing the ends of said chamber.

24. The apparatus as claimed in claim 23, comprising a planar foam strip located in said flotation chamber between said lower plastic liner and said cover, said foam strip extending the length of said flotation means and having a width approximately equal to the distance between the rounded apices of said base portion of said wire-like member, and wherein said foam strip is of a thickness sufficient to provide positive net buoyancy to said flotation means in the event that said flotation chamber fills with liquid.

25. The apparatus as claimed in claim 24, wherein said foam strip comprises:

means forming wedge-shaped notches in the lateral edges thereof at longitudinal intervals to permit articulation of said foam strip laterally while remaining planar.

26. The apparatus as claimed in claim 25, wherein said wedge-shaped notches are provided in pairs, the notches of each pair being oriented opposite one another laterally of said foam strip.

27. In a contamination containment boom of the type adapted to contain a contaminant in a preselected location on a body of liquid, the boom having an elongated flotation means adapted to float on the body of liquid, a closed flexible boom cover impervious to said liquid and to said contaminant, and a weighted skirt means depending from the flotation means and extending downwardly a preselected distance into the body of liquid, the improvement wherein said flotation means has a bottom defining a large water place area compared to its top, and said flotation means comprises:

a pair of spaced apart ballast bags, attached to the exterior of said cover, one adjacent each lower lateral side of said bottom and extending the length of said flotation means, said ballast bags positioned on said cover so as to be substantially submerged in said liquid when said flotation means is deployed, each ballast bag having an enclosed chamber for containing liquid and comprising at least one liquid opening to permit liquid to enter and fill said ballast bag chamber, so as to provide a downward pull on the lower lateral side of said bottom when such lower lateral side is forced out of the water by an external force.

28. The apparatus as claimed in claim 27, including a plurality of liquid openings spaced along the length of each ballast bag, wherein said liquid openings are sized to allow liquid into said ballast bag chamber over a period of time and to restrict the draining of said ballast bag chamber to a time substantially greater than the time said ballast bags are above the liquid level of the body of liquid due to external forces tending to tip said flotation means laterally and force one of said ballast bags to rise out of the liquid.

29. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water place area compared to its top with rounded apices at each side of said bottom and at said top, and said flotation means comprises:

a plurality of wire-like members each having the general shape of the cross section of said flotation means with corresponding rounded apices;

a skeleton frame for said flotation means comprising a plurality of elongated mounting strips extending the length of said flotation means, said wire-like members mounted transversely to said mounting strips;

a relatively flexible one-piece plastic cover having first and second longitudinal side edges extending the length of said flotation means, said cover defining contaminant impervious walls completely surrounding and conforming to the shape of said skeleton frame of said flotation means to envelope an inner elongated flotation chamber and provide end walls closing the ends of said chamber, said cover being wrapped about said skeleton frame by laying out said cover on a work surface with its exterior facing downwardly after which said skeleton frame is placed at its center and said first and second cover side edges are brought up to attach together at the top apex of said skeleton frame;

a relatively stiff upper plastic liner extending the length of said boom and positioned adjacent the top of said wire-like members;

a first velcro strip secured to the outer surface at the center of said upper plastic liner and extending the length of said flotation means;

a first mating velcro strip secured to the interior edge of said first longitudinal edge of said cover, such that when said first longitudinal edge of said cover is brought up to said top apex, said first velcro strip and said first mating velcro strip bind together;

a second velcro strip secured to the exterior edge of said first longitudinal edge of said cover and extending the length of said flotation means; and a second mating velcro strip secured to the interior edge of said second longitudinal edge of said cover, such that when said second longitudinal edge of said cover is brought up to said top apex, said second velcro strip and said second mating velcro strip bind together, completing the covering of said skeleton longitudinally.

30. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top, the cross section of said flotation means having the shape of a triangle with rounded apices, and said flotation means comprises:

a skeleton framework structure having triangular shaped ribs spaced therealong; and a relatively flexible one-piece plastic cover having first and second longitudinal sides extending the length of said boom and defining a single open chamber with contaminant impervious walls completely surrounding and conforming to the shape of said skeleton frame of said flotation means to envelope an inner elongated flotation chamber running the length of said boom and provide end walls closing the ends of said chamber.

31. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top with rounded apices at each side of said bottom and at said top, and said flotation means comprises:

a plurality of wire-like members each having the general shape of the cross section of said flotation means with corresponding rounded apices, a side of each wire-like member defining a base portion and the lateral sides extending upwardly from said portion meeting at an apex opposite said base portion to define a top portion, a transverse portion extending from at least one of said lateral sides toward the opposite lateral side of said wire-like member;

a plurality of elongated mounting strips extending the length of said flotation means;

fastening means for fastening said wire-like members to said mounting strips at intervals therealong to produce a skeleton frame for said flotation means, with said wire-like members mounted transversely to said mounting strips; and a relatively flexible plastic cover defining contaminant impervious walls completely surrounding and conforming to the shape of said skeleton frame of said flotation means to envelop an inner elongated flotation chamber and provide end walls closing the ends of said chamber.

32. The apparatus as claimed in claim 31, comprising a planar foam strip located in said flotation chamber between the base portion of said wire-like members and said cover, said foam strip extending the length of said flotation means and having a width approximately equal to the width of said base portion of wire-like member, and wherein said foam strip is of a thickness sufficient to provide positive net buoyancy to said flotation means in the event that liquid enters said flotation chamber.

33. The apparatus as claimed in claim 32, wherein said foam strip comprises:

means forming wedge-shaped notches in the lateral edges thereof at longitudinal intervals to permit articulation of said foam strip laterally while remaining planar.

34. The apparatus as claimed in claim 33, wherein said wedge-shaped notches are provided in pairs, the notches of each pair being oriented opposite one another laterally of said foam strip.

35. The apparatus as claimed in claim 33, wherein said wedge-shaped notches along one lateral edge of said foam strip alternate with said wedge-shaped notches along the other lateral edge of said foam strip.

36. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top with rounded apices at each side of said bottom and at said top, and said flotation means comprises:

a plurality of wire-like members each having the general shape of the cross section of said flotation means with corresponding rounded apices, a side of each wire-like member defining a base portion and the lateral sides extending upwardly from said base portion meeting at an apex opposite said base portion to define a top portion, a transverse portion extending from at least one of said lateral sides toward the opposite lateral side of said wire-like member;

a relatively stiff plastic liner extending the length of said flotation means;

a plurality of elongated mounting strips extending the length of said flotation means;

fastening means for fastening said wire-like members to said mounting strips at intervals therealong to produce a skeleton frame for said flotation means, with said wire-like members mounted transversely to said mounting strips, said plastic liner completely enveloping said skeleton frame along the entire length thereof; and a relatively flexible plastic cover defining contaminant impervious walls completely surrounding and conforming to the shape of said skeleton frame of said flotation means to envelop an inner elongated flotation chamber and provide end walls closing the ends of said chamber.

37. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a cover with a bottom defining a large water plane area compared to its top with apices at each lateral side of said bottom, and said flotation means comprises:

a ballast bag attached to and depending from the exterior of said cover adjacent the center of the bottom thereof and extending the length of said flotation means, said skirt depending from the bottom of said ballast bag, said ballast bag having an enclosed chamber for containing liquid and comprising at least one liquid opening to permit liquid to enter and fill said ballast bag chamber, said enclosed chamber being defined by said cover bottom on one side thereof, and on two other sides thereof by a pair of flexible sidewalls attached to the top of said skirt and to said cover bottom along spaced parallel lines on either side of the center of said bottom.

38. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top with rounded apices at each side of said bottom and at said top, and said flotation means comprises:

a plurality of wire-like members each having the general shape of the cross section of said flotation means with corresponding rounded apices;

a skeleton frame for said flotation means comprising a plurality of elongated mounting strips extending the length of said flotation means, said wire-like members mounted transversely to said mounting strips;

a relatively flexible one-piece plastic cover having first and second longitudinal side edges extending the length of said flotation means, said cover defining contaminant impervious walls completely surrounding and conforming to the shape of said skeleton frame of said flotation means to envelop an inner elongated flotation chamber and provide end walls closing the ends of said chamber, said cover being wrapped about said skeleton frame by laying out said cover on a work surface with its exterior facing downwardly after which said skeleton frame is placed at its center and said first and second cover side edges are brought up to attach together at the top apex of said skeleton frame; and means for attaching said cover side edges together at or near the top apex of said skeleton frame.

39. In a contamination containment boom of the type adapted to contain a contaminant in a preselected location on a body of liquid, the boom having an elongated flotation means adapted to float on the body of liquid and a weighted skirt means depending from the flotation means and extending downwardly a preselected distance into the body of liquid, the improvement wherein said flotation means has a bottom defining a large water plane area compared to its top, and said flotation means comprises:

a plurality of collapsible wire-like members each having the general shape of the cross section of said flotation means;

a plurality of elongated mounting strips extending the length of said flotation means;

fastening means for fastening said wire-like members to said mounting strips and said mounting strips to said upper and lower plastic liners at intervals therealong to produce a skeleton frame for said flotation means, with said wire-like members mounted transversely to said mounting strips; and a relatively flexible plastic cover defining contaminant impervious walls completely surrounding and conforming to the shape of said skeleton frame of said flotation means to envelop an inner elongated flotation chamber and provide end walls closing the ends of said chamber.

40. The apparatus as claimed in claim 39, wherein:

each one of a consecutive group of adjacent wire-like members is of a different size to define progressively smaller wire-like members from one end of said consecutive group to the other, thereby forming a flotation nose means for said flotation means.

41. The apparatus as claimed in claim 39, wherein:

each said wire-like member has a top portion, a transverse portion, and a base portion and is adapted to fold to a collapsed condition with said top and base portions folded onto one another to create torsion in said transverse portion;

said apparatus further includes a flexible vertical limit strap extending from said top portion of said wire-like member to the center of the base portion thereof, said limit strap being of a length to prevent said wire-like member from fully unfolding to its quiescent unfolded state.

* * * * *